US010316438B2

(12) United States Patent
Lipscomb et al.

(10) Patent No.: US 10,316,438 B2
(45) Date of Patent: Jun. 11, 2019

(54) FABRIC CONTAINING AN INTIMATE BLEND OF ANTISTATIC FIBERS ARRANGED IN A PATTERN

(71) Applicant: Southern Mills, Inc., Union City, GA (US)

(72) Inventors: Lee Lipscomb, Tyrone, GA (US); Robert Self, Peachtree City, GA (US)

(73) Assignee: Southern Mills, Inc., Union City, GA (US)

( * ) Notice: Subject to any disclaimer, the term of this patent is extended or adjusted under 35 U.S.C. 154(b) by 437 days.

(21) Appl. No.: 14/639,567

(22) Filed: Mar. 5, 2015

(65) Prior Publication Data

US 2015/0252499 A1 Sep. 10, 2015

Related U.S. Application Data

(60) Provisional application No. 61/948,314, filed on Mar. 5, 2014.

(51) Int. Cl.

| | |
|---|---|
| ***D03D 15/00*** | (2006.01) |
| ***D02G 3/44*** | (2006.01) |
| ***D02G 3/04*** | (2006.01) |
| ***D04B 1/14*** | (2006.01) |
| *D03D 13/00* | (2006.01) |

(52) U.S. Cl.

CPC ..... *D02G 3/441* (2013.01); *D02G 3/04* (2013.01); *D02G 3/443* (2013.01); *D03D 15/0005* (2013.01); *D04B 1/14* (2013.01); *D03D 13/00* (2013.01); *D10B 2401/16* (2013.01); *Y10T 428/249921* (2015.04); *Y10T 442/3976* (2015.04); *Y10T 442/40* (2015.04)

(58) Field of Classification Search

USPC ..... 442/197, 301

See application file for complete search history.

(56) References Cited

U.S. PATENT DOCUMENTS

| | | | | |
|---|---|---|---|---|
| 5,030,508 | A | 7/1991 | Kuhn et al. | |
| 5,071,699 | A | 12/1991 | Pappas et al. | |
| 5,102,727 | A | 4/1992 | Pittman et al. | |
| 6,946,412 | B2 | 9/2005 | Campbell et al. | |
| 2002/0136859 | A1* | 9/2002 | Fisher | D01F 1/09 428/95 |
| 2006/0068664 | A1* | 3/2006 | Gibson | A41D 31/0022 442/197 |
| 2007/0087149 | A1* | 4/2007 | Arthurs | D02G 3/441 428/36.1 |
| 2013/0212790 | A1* | 8/2013 | Waxman | D02G 3/443 2/458 |
| 2014/0041107 | A1 | 2/2014 | Rose et al. | |

FOREIGN PATENT DOCUMENTS

| | | | | |
|---|---|---|---|---|
| JP | 2007-530819 | | 11/2007 | |
| JP | 2013-522494 | | 6/2013 | |
| JP | 2013-524038 | | 6/2013 | |
| WO | WO-9962082 | A1 * | 12/1999 | G01V 15/00 |
| WO | 02/42165 | A2 | 5/2002 | |
| WO | 2005/099426 | A1 | 10/2005 | |

OTHER PUBLICATIONS

International Search Report and Written Opinion, PCT Application No. PCT/US15/18938, dated May 28, 2015.

International Preliminary Report on Patentability, PCT Application No. PCT/US15/18938, dated Sep. 15, 2016.

Supplementary European Search Report, European Patent Application No. 15758636.3, dated Nov. 28, 2017.

Office Action, Japanese Patent Application No. 2016-555323, dated Apr. 2, 2019, 5 pages.

* cited by examiner

*Primary Examiner* — Jenna L Johnson

(74) *Attorney, Agent, or Firm* — Kilpatrick Townsend & Stockton LLP

(57) ABSTRACT

A fabric includes base yarns and antistatic spun yarns located in discrete portions of the fabric such that the fabric dissipates static electricity by way of an inductive field and complies with one or more standards for static dissipation in fabric. The antistatic spun yarns may include inductive antistatic staple fibers, and may include less than 20% antistatic fiber. The fabric may be a woven fabric with the antistatic spun yarns inserted into the fabric in both the warp and filling directions in a ratio of antistatic spun yarns to base yarns of from 1:1 to 1:40. The fabrics may be flame resistant and comply with one or more standards for flame resistant fabrics and/or may comply with one or more standards for high visibility apparel. The fabric may have a total antistatic fiber content of less than about 1%.

20 Claims, No Drawings

FABRIC CONTAINING AN INTIMATE BLEND OF ANTISTATIC FIBERS ARRANGED IN A PATTERN

CROSS REFERENCE TO RELATED APPLICATION

The present application claims the benefit of U.S. provisional application No. 61/948,314 filed Mar. 5, 2014, the contents of which are incorporated herein by this reference in its entirety.

BACKGROUND

Static electricity has a tendency to build up within and on the surface of fabrics during use. Buildup of static electricity is a nuisance in garment handling and to the wearer and may also pose a hazard to the wearer in certain environments, and in particular in flammable gas environments. As a result, it is desirable for fabrics to prevent or minimize static electricity build up.

It has been known to incorporate antistatic filament yarns into fabrics to satisfy one or more standards for static electricity in apparel, including EN 1149 (Electrostatic properties of protective clothing) and MIL-C-83429B (Military specification: cloth, plain and basket weave, aramid) (as tested in accordance with FTMS 191A Test Method 5931). One known antistatic filament yarn is available from Barnet under the trade name Nega-Stat®. The antistatic filament yarn is a conductive yarn, which dissipates (or prevents the buildup of) static electricity by conducting the electric charge along the filament yarns to a ground (such as the body of a user). The antistatic filament yarn has been incorporated into fabrics in a continuous grid pattern to facilitate conduction of static electricity through the garment. While such constructions effectively dissipate static electricity in the fabric, the filament yarn is expensive and results in a high fabric cost.

Another known method for minimizing or preventing static electricity build up in a fabric is to form a fabric from spun yarns (rather than filament) and incorporate approximately 2% or more antistatic staple fibers into the spun yarns used in the fabric. In this manner, the antistatic staple fibers (such as 401-ECS staple fibers, available from Ascend Performance Materials under the No-Shock® line of products) are more or less evenly distributed throughout the entire fabric. 401-ECS staple fibers have a carbon-based antistatic component. It will be recognized that in such constructions, the antistatic fibers are not continuous and thus will not conduct electricity through the fabric; rather, the antistatic fibers dispersed throughout the fabric dissipate the static electricity that builds up by way of an inductive field.

Antistatic fibers are relatively dark as compared to typical staple fibers used in fabric constructions. As a result, the appearance of fabrics having antistatic staple fibers dispersed throughout the fabric is undesirable when light shades of fabric are desired, and in particular when it is desirable for the fabric to satisfy standards for high visibility apparel. It may not be possible, for example, to satisfy ANSI 107 (High-Visibility Safety Apparel and Headwear) when using a fabric having the relatively darker antistatic staple fibers dispersed throughout. A similar problem can occur when trying to form a fabric from dark shades, as the antistatic fibers, while darker than light shade fibers, are not as dark as commonly used dark shade fibers and will thus appear lighter against the dark background of the other staple fibers. Neither result is desirable. Visual appearance problems can also occur when using conductive antistatic filament yarns in a grid pattern due to voids or variation in the appearance of the filament in the pattern.

SUMMARY

A fabric includes base yarns and antistatic spun yarns that include antistatic staple fibers. The antistatic spun yarns are located in discrete portions of the fabric such that the fabric complies with one or more standards for static dissipation in fabric. Such standards include but are not limited to EN 1149-5, EN 1149-3, MIL-C-83429B, and FTMS 191A Test Method 5931.

In some embodiments the antistatic staple fibers are inductive antistatic staple fibers. In further embodiments the antistatic spun yarns have less than 20% inductive antistatic staple fibers.

The antistatic spun yarns may be woven or knit into the fabric in a grid pattern or a stripe pattern. In one particular embodiment, the fabric is a woven fabric and the antistatic spun yarns are inserted into the fabric in both the warp and filling directions. In certain embodiments the ratio of antistatic spun yarns to base yarns in the woven fabric is from 1:1 to 1:40 in one or both of the warp and filling directions.

The base yarns may be flame resistant yarns such that the fabric complies with one or more standards for flame resistant fabrics. In addition, the fabric may comply with one or more standards for high visibility apparel.

In a particular embodiment, the fabric has a total antistatic fiber content of less than about 1%.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention relate to an antistatic fabric in which the antistatic content in the fabric is provided by an intimate blend including antistatic staple fibers formed into spun yarns, and in which the spun yarns are located in discrete portions of the fabric, such as in a grid or stripe pattern. Locating the antistatic staple fibers in discrete portions of the fabric provides inductive static dissipation properties to the fabric, while also allowing the fabric to meet high visibility requirements. The fabrics of the present invention are different from previous fabrics that included either (1) antistatic conductive filament yarns located in a grid pattern or (2) included antistatic staple fibers blended throughout the fabric.

In embodiments of the invention, a relatively high content of antistatic staple fibers is spun into the yarns ("antistatic spun yarns") that will be located in discrete portions of the fabric, while the remainder of the yarns in the fabric (the "base yarns") may be formed of any desired spun yarns and/or filament yarns. In some embodiments the antistatic spun yarns may include from about 2% to about 50% antistatic staple fiber, with the balance being any other desired staple fiber. In certain embodiments the antistatic spun yarns may include from about 2% to 30% antistatic staple fiber, from about 2% to 20% antistatic staple fiber, from about 2% to 15% antistatic staple fiber, from about 2% to 10% antistatic staple fiber, from about 2% to less than or equal to about 30% antistatic staple fiber, from about 2% to less than or equal to about 20% antistatic staple fiber, from about 2% to less than or equal to about 15% antistatic staple fiber, or from about 2% to less than or equal to about 10% antistatic staple fiber, with the balance being any other desired staple fiber. In one particular embodiment, the antistatic spun yarns may include from about 2% to less than or equal to about 20% antistatic staple fiber. It is notable that in some embodiments of the invention the antistatic spun yarn may include less than 20% or even less than or equal to about 10% antistatic staple fiber and a fabric incorporating such yarns can still satisfy one or more standards for static electricity in apparel by dissipating static using an inductive field; in contrast a fabric utilizing conductive fibers would require at least 20% conductive fibers in the antistatic yarn to ensure adequate contact between the conductive fibers to ensure a conductive path for static dissipation.

The antistatic spun yarns, because they do not include conductive 100% continuous filament (in contrast to antistatic filament yarns), are not conductive yarns and do not provide the fabric with conductive static dissipation properties; rather, the yarns provide the fabric with inductive static dissipation properties. Fabrics of the invention formed from antistatic spun yarns located in discrete portions of the fabric (e.g., in a grid or stripe pattern) may satisfy one or more standards for static electricity in apparel, including but not necessarily limited to EN 1149 (Electrostatic properties of protective clothing) and MIL-C-83429B (Military specification: cloth, plain and basket weave, aramid) (as tested in accordance with FTMS 191A Test Method 5931).

The discovery that fabrics formed from antistatic spun yarns located in discrete portions of the fabric could satisfy these standards—as contrasted with fabrics having antistatic staple fibers distributed throughout the fabric—was surprising. It was previously thought that such fabrics would not provide the fabric with sufficient static dissipation properties because (1) the antistatic spun yarns are not conductive (in contrast to antistatic filament yarns) and (2) the antistatic staple fibers are not distributed throughout all of the yarns in the fabric and would thus not be expected to allow the fabric to form a strong enough inductive field to dissipate the static electricity formed therein.

Another benefit of the fabrics of the present invention is that, because the relatively dark antistatic staple fiber is located in only discrete portions of the fabric, the rest of the fabric can include base yarns (spun yarns or filament yarns) having a lighter shade, or yarns that are dyeable to a lighter shade, such that the fabrics can still satisfy a high visibility standard such as that found in ANSI 107 (High-Visibility Safety Apparel and Headwear). In addition, because the fabrics of the present invention do not include antistatic filament yarns and the defects found therein (noted above), the fabrics of the present invention are free from these visual defects.

The fabrics of the present invention, having a relatively high content of antistatic staple fibers spun into yarns located in discrete portions of the fabric, may have a total antistatic fiber content in the fabric of from about 0.125% to about 5%, and in some embodiments from about 0.125% to about 2%, about 1% or even about 0.5%. In yet other embodiments, the fabric has a total antistatic fiber content of less than or equal to about 5%, less than or equal to about 2%, less than or equal to about 1% or less than or equal to about 0.5%. As discussed above, it was surprising that these fabrics, having such a low total content of antistatic staple fibers located in only discrete portions of the fabric, would have acceptable static electricity properties. For purposes of comparison, previously known fabrics including conductive antistatic filament yarns had an antistatic content of at least 1%, and fabrics including an intimate blend of antistatic staple fibers dispersed throughout the entire fabric had an antistatic content of at least 2%.

The antistatic spun yarns may be located in discrete portions of the fabric in any desirable pattern. In some exemplary embodiments, the antistatic spun yarns are woven or knit into the fabric in a grid pattern or a stripe (e.g., horizontal or vertical) pattern. Any desirable weave (e.g., plain, twill) or knit (e.g., single, double, plain, interlock) pattern may be used. Further, the antistatic spun yarns may be located in either the warp or filling direction in the fabric or, when incorporated into the fabric in, e.g., a grid pattern, in both the warp and filling directions.

The antistatic spun yarns may also be plied with one or more other antistatic spun yarns and/or with one or more non-antistatic yarns (spun or filament) to form a thicker plied yarn.

In some embodiments, the fabric is a woven fabric and no more than one antistatic spun yarn is inserted into the fabric for every 40 base yarns in either or both of the warp and filling directions. In other words, the ratio of antistatic spun yarn to base yarn in the fabric is no more than 1:40. In some embodiments, the ratio of antistatic spun yarn to base yarns is from 1:1 to 1:40 in either or both of the warp and filling directions, or in other embodiments from 1:1 to 1:35, or from 1:1 to 1:30, from 1:1 to 1:25, from 1:5 to 1:40, from 1:5 to 1:35, from 1:5 to 1:30, from 1:5 to 1:25, from 1:10 to 1:40, from 1:10 to 1:35, from 1:10 to 1:30, from 1:10 to 1:25, from 1:15 to 1:40, from 1:15 to 1:35, from 1:15 to 1:30, or from 1:15 to 1:25 in either or both of the warp and filling directions.

As mentioned above, the antistatic spun yarns can include any other desirable staple fiber in addition to the antistatic staple fiber, and the remainder of the yarns in the fabric (base yarns) can include any desired spun yarns and/or filament yarns. In some embodiments of the invention the fabric includes no antistatic fibers (filament or spun) other than the antistatic staple fibers located in the antistatic spun yarns, although it will be recognized that the base yarns could include a small amount of antistatic fibers which could enhance the inductive static dissipation properties of the fabric without substantially affecting the high visibility performance of the fabric.

The antistatic staple fiber can be any suitable antistatic fiber. One such fiber is 401-ECS, available from Ascend Performance Materials under the No-Shock® line of products. 401-ECS staple fibers are inductive antistatic staple fibers, as they have a core/sheath construction with a carbon-containing core and a nonconductive polyamide sheath. Even though the 401-ECS staple fibers have a carbon-containing core (carbon dispersed in a polymeric matrix), the fibers are not conductive because the relatively large amount of nonconductive sheath in the fiber prevents the carbon-containing core from contacting the cores of other antistatic fibers when the fibers are spun into the yarn with other non-antistatic fibers, which prevents the antistatic spun yarns from conducting electricity. Thus, rather than functioning as conductive yarns, the antistatic spun yarns, when formed into a fabric in accordance with embodiments described herein, provide the fabric with inductive static dissipation properties. Accordingly, in some embodiments of the invention the antistatic staple fiber may be an inductive antistatic staple fiber. In yet other embodiments the antistatic staple fiber may be a conductive staple fiber such as carbon fiber or stainless steel.

In some embodiments, the fabric is a protective fabric suitable for use in personal protective apparel. In certain embodiments, the fabric is a flame resistant fabric that satisfies one or more standards for flame resistant fabrics, including but not limited to NFPA 2112 (Standard on Flame-Resistant Garments for Protection of Industrial Personnel Against Flash Fire).

Exemplary suitable fibers for use in the base yarn of the present invention include, but are not limited to, flame resistant fibers such as para-aramid fibers, polybenzoxazole (PBO) fibers, PBI fibers, modacrylic fibers, poly{2,6-diimidazo[4,5-b:40; 50-e]-pyridinylene-1,4(2,5-dihydroxy)phenylene} ("PIPD") fibers, and natural and synthetic flame resistant cellulosic fibers (either naturally flame resistant or treated to make them flame resistant), such as but not limited to lyocell and FR rayon. Examples of para-aramid fibers include KEVLAR™ (available from DuPont), TECHNORA™ (available from Teijin Twaron BV of Arnheim, Netherlands), and TWARON™ (also available from Teijin Twaron BV). An example of a PIPD fiber includes M5 (Dupont). In some embodiments, the base yarns are formed entirely from these fibers. For example, all of the base yarns in the fabric may be formed with 100% of a single type of these fibers or alternatively a blend of different types of these fibers. Moreover, base yarns formed entirely from these fibers may be all or an intimate blend of staple fibers, filaments, or a combination of filaments and staple fibers.

In other embodiments, the base yarns in the fabric include fibers such as those disclosed above and one or more types of secondary fibers that are used to enhance a secondary property of the fabric other than flame resistance (e.g., comfort, dyeability/printability, etc.) (referred to as "secondary fibers"). For example, some embodiments of the fabric may be formed from yarns having 100% flame resistant fibers (such as those disclosed above) and yarns that include one or more types of secondary fibers (either in addition to, or to the exclusion of, the flame resistant fibers described above). In other embodiments, yarns forming the fabric are formed from a blend of one or more flame resistant fibers (such as those disclosed above) and one or more types of secondary fibers. The blended yarns may be a combination of spun fibers, filaments, or a combination of filaments and staple fibers.

Such secondary fibers can be selected to enhance a property of the fabric, such as, but not limited to, the comfort, durability, and/or dyeability/printability of the fabric. The secondary fibers may also be flame resistant.

Secondary fibers that enhance the comfort of the fabric (i.e., have higher moisture regain, soft hand, etc.) are referred to herein as "comfort fibers." "Comfort fibers" as used herein include, but are not limited to, cellulosic fibers, polybenzimidazole (PBI) fibers, TANLON™ (available from Shanghai Tanlon Fiber Company), rayon, wool, and blends thereof. Examples of cellulosic fibers include cotton, rayon, acetate, triacetate, and lyocell fibers (as well as their flame resistant counterparts FR cotton, FR rayon, FR acetate, FR triacetate, and FR lyocell). Examples of suitable rayon fibers are Viscose™ and Modal™ by Lenzing, available from Lenzing Fibers Corporation. Examples of lyocell fibers include TENCEL G100™ and TENCEL A100™, both available from Lenzing Fibers Corporation. An example of an FR rayon fiber is Lenzing FR™, also available from Lenzing Fibers Corporation.

Secondary fibers that enhance the dyeability/printability of the fabric are referred to herein as "dyeable fibers" and include fibers that are dyeable and dyestuff printable (as opposed to pigment printable). "Dyeable fibers" as used herein include, but are not limited to, modacrylic fibers, cellulosic fibers, meta-aramid fibers, polybenzimidazole (PBI) fibers, melamine fibers, TANLON™ (available from Shanghai Tanlon Fiber Company), rayon, polyester, polyvinyl alcohol, wool, polyetherimide, polyethersulfone, polyamide, and blends thereof. An example of a suitable modacrylic fiber is PROTEX™ available from Kaneka Corporation of Osaka, Japan. Examples of cellulosic fibers include cotton, rayon, acetate, triacetate, and lyocell fibers (as well as their flame resistant counterparts FR cotton, FR rayon, FR acetate, FR triacetate, and FR lyocell). Examples of suitable rayon fibers are Viscose™ and Modal™ by Lenzing, available from Lenzing Fibers Corporation. Examples of lyocell fibers include TENCEL G100™ and TENCEL A100™, both available from Lenzing Fibers Corporation. An example of an FR rayon fiber is Lenzing FR™, also available from Lenzing Fibers Corporation. Examples of meta-aramid fibers include NOMEX™ (available from DuPont), CONEX™ (available from Teijin), and Kermel (available from Kermel). An example of melamine fibers is BASOFIL™ (available from Basofil Fibers).

Additional secondary fibers suitable for use in the base yarns of the invention include, but are not limited to ultra-high density polyethylene fibers, carbon fibers, silk fibers, polyamide fibers, and polyester fibers. Examples of ultra-high density polyethylene fibers include Dyneema and Spectra. An example of a polyester fiber is VECTRAN™ (available from Kuraray).

Fabrics according to the invention can have any desirable weight. In some embodiments, single or multi-layer fabrics can have a weight of from about 1 to 20 osy, or from about 3 to 15 osy, or even 3 to 12 osy or 4 to 9 osy.

As discussed above, the antistatic spun yarns can include any other desirable staple fiber in addition to the antistatic staple fiber. Such staple fibers include, but are not limited to, any of the flame resistant or secondary fibers described above, including blends thereof.

The present invention is further illustrated by the following examples which illustrate specific embodiments of the invention but are not meant to limit the invention.

EXAMPLE 1

Sample fabrics having the following construction were prepared and tested against various standards for static electricity in apparel (fiber content listed as a percentage):

| Sample | Construction |
|---|---|
| A | AS: 38/30/12/20 (modacrylic/lyocell/para-aramid/antistat)<br>Base: 48/37/15 (modacrylic/lyocell/para-aramid)<br>Total: 47/37/15/1 (modacrylic/lyocell/para-aramid/antistat)<br>Const: 2-ply AS/2-ply Base twill weave; AS yarns inserted in a grid pattern with an AS yarn inserted every 21$^{st}$ yarn in warp direction and every 18th yarn in filling direction<br>Fabric weight: 5.8 osy |
| B | AS: 44/33/13/10 (modacrylic/lyocell/para-aramid/ |

-continued

| Sample | Construction |
|---|---|
| | antistat)<br>Base: 48/37/15 (modacrylic/lyocell/para-aramid)<br>Total: 47.5/37/15/0.5 (modacrylic/lyocell/para-aramid/antistat)<br>Const: 2-ply AS/2-ply Base twill weave; AS yarns inserted in a grid pattern with an AS yarn inserted every 21$^{st}$ yarn in warp direction and every 18$^{th}$ yarn in filling direction<br>Fabric weight: 5.8 osy |
| C | AS: 46/35/14/5 (modacrylic/lyocell/para-aramid/ antistat)<br>Base: 48/37/15 (modacrylic/lyocell/para-aramid)<br>Total: 47.75/37/15/0.25 (modacrylic/lyocell/para-aramid/antistat)<br>Const: 2-ply AS/2-ply Base twill weave; AS yarns inserted in a grid pattern with an AS yarn inserted every 21$^{st}$ yarn in warp direction and every 18$^{th}$ yarn in filling direction<br>Fabric weight: 5.8 osy |
| D (Control) | AS: N/A<br>Base: 48/37/15 (modacrylic/lyocell/para-aramid)<br>Total: 48/37/15 (modacrylic/lyocell/para-aramid)<br>Const: 2-ply Base twill weave<br>Fabric weight: 5.8 osy |

AS: Antistatic spun yarns
Base: Base yarns
Total: Total content of fiber in fabric
Const: fabric construction
antistat: 401-ECS staple fiber All of the sample fabrics satisfied the high visibility requirements of ANSI 107.

Static Decay

Static decay testing was conducted for each fabric for compliance with MIL-C-83429B (as tested in accordance with FTMS 191A Test Method 5931), copies of which are appended, with the following results:

| | Sample | | | | |
|---|---|---|---|---|---|
| Before wash: | A | B | C | D | Requirement |
| Warp | | | | | |
| +5k A/C Avg Decay | 5000 | 5000 | 5000 | 5000 | 4000 min |
| Time (sec) | 0.04 | 0.08 | 0.24 | 2.14 | 0.5 sec max |
| −5k A/C Avg Decay | 4750 | 4833 | 4750 | 4583 | 4000 min |
| Time (sec) | 0.05 | 0.09 | 0.28 | 2.47 | 0.5 sec max |
| Filling | | | | | |
| +5k A/C Avg Decay | 5000 | 5000 | 5000 | 5000 | 4000 min |
| Time (sec) | 0.05 | 0.17 | 0.28 | 3.32 | 0.5 sec max |
| −5k A/C Avg Decay | 4750 | 4750 | 4667 | 4750 | 4000 min |
| Time (sec) | 0.05 | 0.15 | 0.32 | 3.98 | 0.5 sec max |

All fabrics including antistatic spun yarns (Samples A, B and C) satisfied the static decay requirement, while the control (Sample D) did not.

Induction Decay

Induction decay testing was conducted for fabrics A, B and C for compliance with EN 1149-5 (2008) and EN 1149-3 (2004 Method 2 Induction decay). Each fabric was conditioned and tested at 23±1° C. and 25±5% r.h. A cleansing pretreatment of five wash/dry cycles according to EN ISO 6330 (2012 Procedure 5M) was conducted at 50° C. with tumble drying (Procedure F, max. 60° C. outlet temperature). The results are summarized below:

| | Sample | | | EN 1149-5 |
|---|---|---|---|---|
| | A | B | C | Standard |
| Gap between threads, mm (mean) | 8.0 | 8.0 | 8.0 | ≤10 mm |
| Shielding factor, S (mean) | 0.57 | 0.48 | 0.36 | S > 0.2 and/or $t_{50}$ less than 4 seconds |
| Half decay time ($t_{50}$), seconds (mean) | <0.01 | <0.01 | 0.19 | |

As can be seen from the test results, each of Samples A, B and C satisfied the EN 1149-5 requirements for induction decay.

The induction decay test results can be compared to known prior art antistatic fabrics, including those including conductive antistatic filament yarns (Comparative Fabric A) and an intimate blend of antistatic fibers dispersed throughout the fabric (Comparative Fabric B). Induction decay test results of these fabrics are provided below for comparison.

Comparative Fabric A: 47/37/15/1 (modacrylic/lyocell/para-aramid/Nega-Stat® antistatic filament (total content in fabric). Fabric weight: 5.8 osy.

Comparative Fabric B: 47/36/14/3 (modacrylic/lyocell/para-aramid/No-Shock® antistatic staple fiber (total content in fabric). Fabric weight: 5.8 osy.

| | Comparative Fabric | | EN 1149-5 |
|---|---|---|---|
| | A | B | Standard |
| Gap between threads, mm (mean) | 9.0 | N/A | ≤10 mm |
| Shielding factor, S (mean) | 0.67 | 0.87 | S > 0.2 and/or $t_{50}$ less than 4 seconds |
| Half decay time ($t_{50}$), seconds (mean) | <0.01 | <0.01 | |

Comparative Fabrics A and B, like Samples A, B and C, each satisfied the EN 1149 requirements as expected. It is notable, however, that the total antistatic content in the fabrics was 1% (Comparative Fabric A) and 3% (Comparative Fabric B). As seen above, however, fabrics according to the present invention can be made with a substantially lower antistatic fiber content while still satisfying the EN 1149 requirements. The reduction in antistatic fiber content reduces the cost of the fabric and makes it easier for the fabric to satisfy high visibility requirements because less of the relatively darker antistatic fibers are included in the fabric. Further, when used in darker shades, fabrics according to the present invention provide a more visually desirable fabric because less of the relatively lighter antistatic fibers are present in the fabric (as compared to the darker base fibers in the fabric).

EXAMPLE 2

Another sample fabric having a higher weight and the following construction was prepared and tested for induction decay (fiber content listed as a percentage):

| Sample | Construction |
|---|---|
| E | AS: 38/30/12/20 (modacrylic/lyocell/para-aramid/ antistat)<br>Base: 48/37/15 (modacrylic/lyocell/para-aramid)<br>Total: 47/37/15/1 (modacrylic/lyocell/para-aramid/antistat)<br>Const: 2-ply AS/2-ply Base twill weave; AS yarns inserted in a grid pattern with an AS yarn inserted every $25^{th}$ yarn in warp direction and every $18^{th}$ yarn in filling direction<br>Fabric weight: 7.4 osy |

AS: Antistatic spun yarns
Base: Balance of fabric
Total: Total content of fiber in fabric
Const: fabric construction
antistat: 401-ECS staple fiber Induction decay testing was conducted for fabric E for compliance with EN 1149-5 (2008) and EN 1149-3 (2004 Method 2 Induction decay). The fabric was conditioned and tested at 23±1° C. and 25±5% r.h. A cleansing pretreatment of five wash/dry cycles according to EN ISO 6330 (2012 Procedure 4N) was conducted at 40±3° C. with tumble drying (Procedure F, max. 60° C. outlet temperature). Washing was performed in a Wascator Machine (Type A1) using reference detergent 3. Type III, 100% polyester was utilized as the ballast, and the total air-dry mass of the specimens and ballast was 2.01 kg. The results are summarized below:

| | Sample E | EN 1149-5 Standard |
|---|---|---|
| Gap between threads, mm (mean) | 9.0 | ≤10 mm |
| Shielding factor, S (mean) | 0.64 | S > 0.2 and/or |
| Half decay time ($t_{50}$), seconds (mean) | <0.01 | $t_{50}$ less than 4 seconds |

As can be seen from the test results, Sample E satisfied the EN 1149-5 requirements for induction decay.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

We claim:

1. A woven fabric having a warp direction and a fill direction, the fabric comprising:
- base yarns comprising flame resistant fibers; and
- antistatic spun yarns comprising 30% or less inductive antistatic staple fibers,
- wherein the antistatic spun yarns are located in at least one of the warp direction and the fill direction of the fabric, wherein adjacent antistatic spun yarns in the at least one of the warp direction and the fill direction are separated by a distance, wherein the distance is no more than approximately 1 centimeter, wherein the woven fabric complies with EN 1149-5 (2008), and wherein the base yarns are devoid of antistatic staple fibers.

2. The woven fabric of claim 1, wherein the fabric further complies with at least one of MIL-C-83429B and FTMS 191A Test Method 5931.

3. The woven fabric of claim 1, wherein the antistatic spun yarns comprise less than or equal to approximately 20% inductive antistatic staple fibers.

4. The woven fabric of claim 1, wherein the antistatic spun yarns are woven into the fabric in a grid pattern or a stripe pattern.

5. The woven fabric of claim 4, wherein the antistatic spun yarns are inserted into the fabric in both the warp direction and the fill direction.

6. The woven fabric of claim 1, wherein the antistatic spun yarns are woven into the fabric in the at least one of the warp direction and the fill direction in a ratio of antistatic spun yarns to base yarns of from 1:1 to 1:40.

7. The woven fabric of claim 1, wherein the fabric further complies with NFPA 2112.

8. The woven fabric of claim 1, wherein the fabric further complies with ANSI 107.

9. The woven fabric of claim 1, wherein the fabric has a total antistatic fiber content of less than about 1%.

10. The woven fabric of claim 1, wherein:
- the fabric further complies with NFPA 2112;
- the fabric further complies with ANSI 107;
- the antistatic spun yarns comprise 30% or less inductive antistatic staple fiber, with the balance being non-antistatic fibers;
- the total antistatic fiber content in the fabric is from about 0.125% to about 2; and
- the antistatic spun yarns are woven in the fabric in both the warp direction and the fill direction in a ratio of antistatic spun yarns to base yarns of from 1:5 to 1:40.

11. The woven fabric of claim 1, wherein the inductive antistatic staple fibers of the antistatic spun yarns are intimately blended with at least one other type of staple fiber, wherein the at least one other type of staple fiber is non-antistatic staple fiber.

12. The woven fabric of claim 11, wherein the at least one other type of staple fiber comprises at least one of aramid fibers, PBO fibers, PBI fibers, modacrylic fibers, PIPD fibers, cellulosic fibers, and melamine fibers.

13. The woven fabric of claim 12, wherein the at least one other type of staple fiber comprises aramid fibers, modacrylic fibers, and cellulosic fibers.

14. The woven fabric of claim 1, wherein the flame resistant fibers of the base yarns comprise at least one of aramid fibers, PBO fibers, PBI fibers, modacrylic fibers, PIPD fibers, flame resistant cellulosic fibers, and melamine fibers.

15. The woven fabric of claim 14, wherein the flame resistant fibers of the base yarns comprise aramid fibers and modacrylic fibers.

16. The woven fabric of claim 15, wherein the modacrylic fibers comprise less than 60% of the base yarns.

17. The woven fabric of claim 16, wherein the modacrylic fibers comprise less than 50% of the base yarns.

18. The woven fabric of claim 15, wherein the base yarns further comprise cellulosic fibers.

19. The woven fabric of claim 18, wherein the cellulosic fibers are non-flame resistant.

20. The woven fabric of claim 1, wherein:
- the antistatic spun yarns further comprise aramid fibers, modacrylic fibers, and cellulosic fibers;
- the base yarns are devoid of antistatic staple fibers;
- the flame resistant fibers of the base yarns comprise aramid fibers and modacrylic fibers;

the modacrylic fibers comprise less than 60% of the base yarns; and the base yarns further comprise non-flame resistant cellulosic fibers.

* * * * *